US007885416B2

(12) United States Patent
Chalupper et al.

(10) Patent No.: US 7,885,416 B2
(45) Date of Patent: Feb. 8, 2011

(54) DEVICE AND METHOD TO ADJUST A HEARING DEVICE

(75) Inventors: Josef Chalupper, Paunzhausen (DE); Matthias Fröhlich, Dechsendorf (DE); Thomas Hopf, Oberreichenbach (DE); Reinier Kortekaas, Erlangen (DE); Kristin Rohrseitz, Erlangen (DE); Christian Weistenhöfer, Bubenreuth (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1065 days.

(21) Appl. No.: 10/788,521

(22) Filed: Feb. 27, 2004

(65) Prior Publication Data

US 2004/0208330 A1 Oct. 21, 2004

(30) Foreign Application Priority Data

Feb. 27, 2003 (DE) ..... 103 08 653

(51) Int. Cl.
*H04R 29/00* (2006.01)
*H04R 25/00* (2006.01)

(52) U.S. Cl. ..... 381/60; 381/312; 381/314

(58) Field of Classification Search ..... 381/60, 381/314, 312, 315, 316
See application file for complete search history.

(56) References Cited

U.S. PATENT DOCUMENTS 5,825,894 A 10/1998 Shennib
6,035,050 A * 3/2000 Weinfurtner et al. ..... 381/313
2002/0078161 A1* 6/2002 Cheng ..... 709/208
2002/0191806 A1 12/2002 Rohrseitz et al.
2004/0013280 A1* 1/2004 Niederdrank ..... 381/315

FOREIGN PATENT DOCUMENTS

DE 40 20 154 A1 1/1992
DE 198 15 373 A1 10/1999
DE 101 15 896 A1 11/2002
EP 0 941 014 A2 9/1999
WO WO 02/28143 A2 4/2002

OTHER PUBLICATIONS

U.S. Appl. No. 09/281,943.

* cited by examiner

*Primary Examiner*—Vivian Chin
*Assistant Examiner*—George Monikang
(74) *Attorney, Agent, or Firm*—Schiff Hardin LLP

(57) ABSTRACT

If a hearing device user has become accustomed to the tone of a hearing device, it is difficult for him to change over to a new hearing device, since this normally possesses a different tone. Therefore, given a treatment with a second or subsequent device, the settings of the old hearing device can be acquired with a computer-controlled event and be considered in a first adjustment given the adaptation of the new hearing device. The new setting then results from the audiometric measurements, the data of the previous device, and if necessary further data. The tone of the new device is thus approximated to the old device.

10 Claims, 3 Drawing Sheets

DEVICE AND METHOD TO ADJUST A HEARING DEVICE

BACKGROUND OF THE INVENTION

The present invention concerns a method and a device for individually adjusting a hearing device for a hearing device user.

Technical advances and new scientific insights lead to a continuous development of hearing devices. This concerns both the signal processing algorithms used and the individual parameter sets calculated from the audiometric data for hearing device settings. In many cases, these developments are considered in new devices.

However, due to the continuous wearing of an auditory system, a person hard of hearing becomes accustomed to the transfer properties of this auditory system, and thus, for example, to the sound. If he requires a new device, for example due to a worsening of his hearing, he often feels the unfamiliar sound to be strange and refuses a new auditory system. This refusal in particular occurs given modern auditory systems, since, in these, very smooth frequency responses can frequently be realized due to the advances in digital technology. For this reason, given a post-treatment, the same type of auditory system already worn is often used instead of a modern auditory system. Thus no improvement occurs for the person hard of hearing, and he does not benefit from the development of auditory systems.

Nevertheless, if a hearing device user is ready to use a new device, the hearing device acoustician generally attempts to match by hand the acoustics of the old device with those of the new in order to ease the transfer. Since modern hearing devices are extremely complex, it is often not possible in this manner to find the optimal setting at which, on the one hand, the sound of the old device is matched and at which, on the other hand, the advantages of the new device are still shown to be advantageous.

A further easing for the transfer to a new hearing device system can be achieved in that a plurality of acclimation stages are used. The acclimation stages effect a slow approach by approximation to the actual aforementioned amplification of the auditory system, independent of the actual client wishes. In the adaptation to a new auditory system, a specific acclimation stage ("for the inexperienced") is first selected. If the person hard of hearing has become accustomed to this setting over a period of some weeks, at the next visit to the acoustician the next acclimation stage is set. In this manner, the actual desired setting that is optimal from the audiological point of view is achieved. However, this requires a plurality of sessions at the acoustician. During this acclimation cycle, the person hard of hearing must become accustomed to a new sound. If this does not succeed, the acoustician must optimize the new auditory system by hand or, respectively, aided by questionnaires.

In known systems, the parameters of the old hearing device are read out or, respectively, the characteristic curves are displayed in the adaptation software. The new hearing device is then manually adjusted such that the amplification curves come as close as possible to the old ones. This manual method is very time-consuming and, due to the complexity of modern hearing devices, leads to good correspondence only with great effort and given sufficient expertise. In all cases, the transfer of the setting parameters directly (for example, channel amplification) does not lead to success, since the setting parameters lead to different absolute amplification characteristic curves, even in various hearing devices of the same family of a manufacturer.

SUMMARY OF THE INVENTION

The object of the present invention is thus to optimize the adjustment of a hearing device based on considerations of a hearing device user and a previous device of the user's.

This object is inventively achieved via a method to automatically adjust a second hearing device by analyzing a first hearing device under the provision of an analysis result; determining setting parameters of the second hearing device with the analysis result of the first hearing device; and adjusting the second hearing device based on the determined setting parameters.

Moreover, a device is inventively provided for automatic adjustment of a second hearing device, with an analysis device to analyze a first hearing device under provision of an analysis result; a determination device to determine setting parameters of the second hearing device with the analysis result of the first hearing device; and an adjustment device to adjust the second hearing device on the basis of the determined setting parameters.

Various embodiments and advantages of these embodiments are described below.

With the aid of embodiments of the invention, the auditory system can be set like the old auditory system, whereby the sound in a quieter environment is similar to the sound of the old auditory system. In a noisy environment, however, the hearing device user can benefit from the advantages of a new auditory system such as, for example, speech recognition, a directional microphone, and the like. The client can become accustomed to the new auditory system faster via a familiar sound. The analysis can comprise a readout of the setting parameters of the old or, respectively, of the first hearing device. This readout is a good aid in order to obtain fast analysis results.

Alternatively or additionally, the first hearing device can be analyzed, in that input sound signals are presented and the output sound signals generated at the hearing device output are tested. This also leads to the goal given hearing devices that are incompatible with a readout device with regard to hardware or software.

The automatic analysis can, however, also comprise a readout of setting parameters and simulation of the performance of the first hearing device with a simulation model. Elaborate measurements can be foregone via this simulation. After the adjustment of the second hearing device, it should be acoustically measured. This serves to test the setting that was implemented on the basis of the setting parameters of the first hearing device. The setting of the second hearing device can ensue via contact-connected or contact-less supply of setting values. It is therewith no longer necessary that an acoustician manually effects the corresponding adjustments.

Furthermore, the adjustment of the second hearing device can ensue using a dynamic model. This eases the adjustment event, since the results of the effected adjustments can be modeled beforehand.

A dynamic model, in comparison to a static model, means a model with which the output audio signals of a hearing device that derive from arbitrary input signals can be simulated. In particular, transient effects of the hearing device can be taken into account with the dynamic model. In contrast to this, only steady states can be simulated with a static model. With a static model, typically only amplification curves that can be determined from the spectral input information are acquired. However, current audiological measurements should always be taken into account in the adjustment of the second hearing device. Based on these measurements, a target specification can be developed that can then be altered using the setting parameters of the first hearing device.

After the adjustment of the second hearing device with the determined setting parameters, the setting parameters can be changed to predefined setting parameters in a predetermined time span. It is therewith possible to gradually change the setting corresponding to the old hearing device into a new, advanced setting that only the new hearing device enables. The acceptance of a new hearing device is clearly increased via this temporally continuously running adaptation event. The time spans for the continuous automatic adaptation can thereby be arbitrarily selected.

DESCRIPTION OF THE DRAWINGS

The present invention is explained below in detail using the attached drawings.

DETAILED DESCRIPTION OF THE PREFERRED EMBODIMENTS

Figure 1:
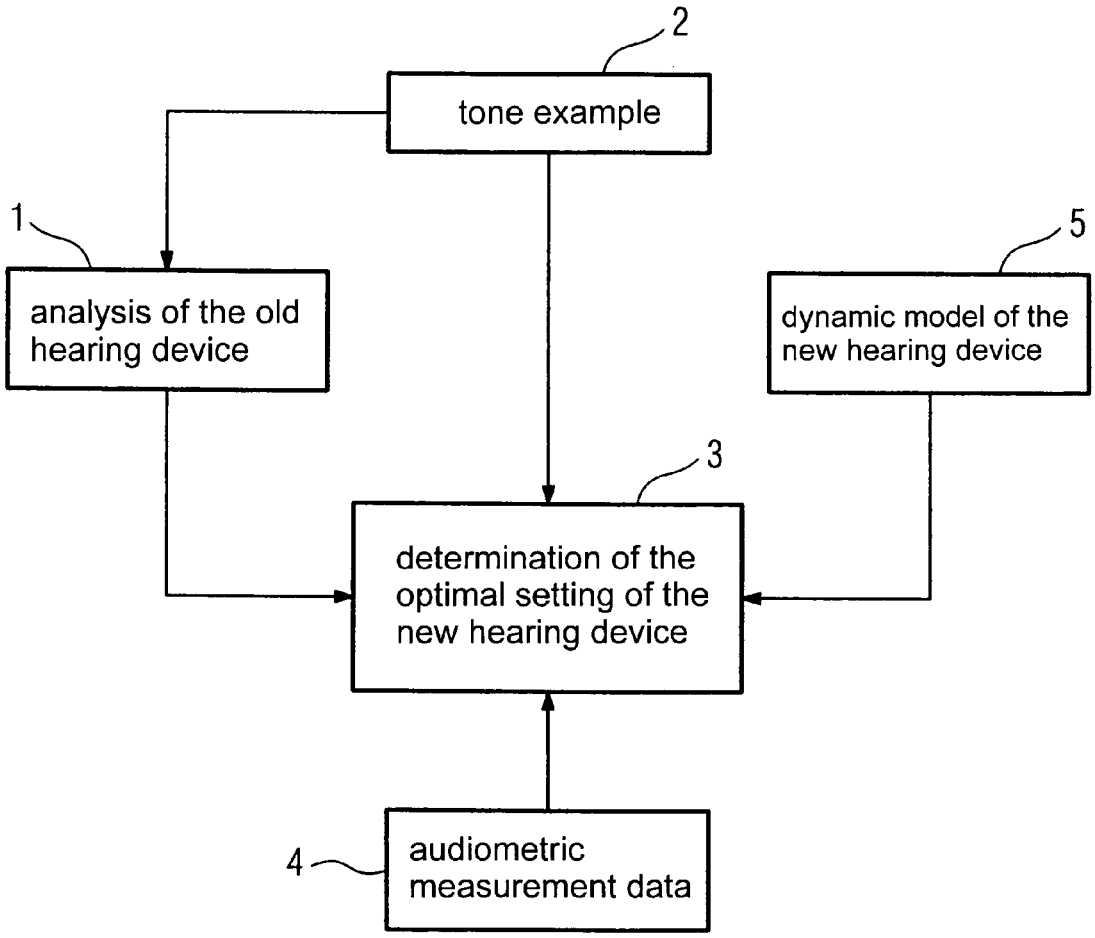
FIG. 1 is a flow chart for optimization of the hearing device pre-adjustment given a second treatment.

The exemplary embodiments subsequently explained in detail represent preferred embodiments of the present invention.

To adapt a new hearing device to an old hearing device while retaining the sound characteristic of the old hearing device, the transfer characteristic curves of the old hearing device are determined and serve as a target amplification to adjust the new hearing device. This means that both the sound characteristics of the old hearing device and the special fine adjustment of the old hearing device are retained. Such an adaptation with regard to the acoustic characteristics of an old hearing device can be helpful both in the change-over to a hearing device of another manufacturer and in the replacement of a hearing device by a newer or more complex product of the same manufacturer, or in the change-over to another design (for example, from a behind-the-ear (BtE) device to an in-the-ear (ItE) device).

Corresponding to an embodiment of the present invention, an automatic adaptation of the new hearing device to target amplification characteristic curves (frequency-dependent an level-dependent targets) is therefore provided, whereby the targets are acquired not as conventional formulas based on audio threshold audiometrics (for example, NAL-NL1, DSL [i/o]), but rather represent the associated amplification characteristic curves of the old hearing device. These targets can thus replace the conventional, formula-based targets as input parameters for a first-fit algorithm.

In the general case, the amplification characteristic curves of the old hearing device can inventively be determined by measuring the hearing device amplification. This can ensue via an arbitrary appropriate measurement apparatus, for example, as a coupling measurement, in-situ measurement, KEMAR, etc. Arbitrary stimuli can be used for the measurement of the characteristic curves, however, a speech-simulating noise is preferably used. As the case may be, the acquired amplification characteristic line must be transformed before it can be input into the first fit algorithm for first adaptation (for example, coupler recordings must transformed into Aided Response data by way of RECD when the first fit algorithm automatically adjusts the hearing device on the basis of Aided Response targets.

The overall process of the measurement of the old hearing device and the subsequent adjustment of the new hearing device preferably ensues fully automatically. Alternatively, the characteristic curves of the old hearing device can ensue semi-automatically (with interaction by the implementing person). However, the adjustment of the new hearing device on the basis of the determined curves ensues automatically in any case, meaning without requiring an interaction by the user.

In the special case that a software model of the old hearing device exists, the measurement of the amplification characteristic curves can also be replaced by the corresponding simulation. This case can, for example, occur when the old device is to be replaced by another device of the same manufacturer (for example, a better hearing device or another design of the same hearing device). In this case, the measurement of the hearing device characteristic curves of the old hearing device can be replaced by a simulation of these characteristic curves. This reduces the potential errors that can occur in the measurement and in general accelerates the overall event, since the simulation is normally implemented faster as one measurement.

The block diagram reproduced in FIG. 1 shows in principle the events for adjusting a new hearing device. For this, the old hearing device to which the hearing device user has become accustomed is analyzed 1. A sound example 2 serves as an input signal for the analysis 1. The analysis data acquired in the automatic analysis method 1 are drawn upon to determine 3 the optimal setting of the new hearing device. The sound examples 2 used as input signals for the analysis are thereby also used. Naturally, the adjustment ensues before the background of the audiometric measurement data 4. Moreover, other values are also drawn upon for the adjustment, for example, experiences of the hearing device user with the hearing devices "Auditive Lifestyle", etc. are drawn upon for a pre-adjustment ("FirstFit") of the new hearing device.

A dynamic model of the new hearing device 5 is used for this in order to model the functionality of the hearing device dependent on specific input quantities. This accelerates the adjustment method, since specific elaborate measurements can be foregone. Alternatively, the new hearing device itself can also be used in place of the dynamic model of the new hearing device. However, this is very costly due to the programming duration and measurement duration.

Thus, in the calculation of the pre-setting of a hearing device, one can not only refer to audiometric and other data of the person hard of hearing, but rather must also refer to analyses of the hearing device worn until now. Not only the static properties but also the dynamic properties are determined in such an analyses, independent of the hearing device signal processing (number of the channels, etc.).

All prevalent hearing device measurement methods for "insertion gain", frequency response, tuning and settling behavior, input/output characteristic curves, etc. that are used throughout artificial test signals such as sine tones, chirps, noises, artificial speech, etc. can be used as analysis methods. The method introduced in the article "Perzeptive Analyse von Kompressionssystemen", Josef Chalupper, DGA 2002 has proven to be particularly suitable. In this method, arbitrary measurement signals (also speech and music) can be used and the hearing device output signals are considered from the view of the human receiver. In contrast to this, all prevalent methods are based on physical model assumptions about the hearing device. In these novel methods, both hearing device input signals and hearing device output signals are analyzed under consideration of the properties of the human receiver with regard to time and frequency resolution, recruitment, quiet auditory threshold and the like, and from this, an effective amplification is calculated. Results of prevalent methods can also be incorporated in the calculation of this effective amplification.

In detail, the analysis ensues in that a test signal is first selected under consideration of preferences of the user. For this, for example, music is used as a test signal when the user is above all pleased with the tone of this old device given music. The hearing device is subsequently exposed to this test signal. Already existing devices, for example, measurement box, audio shoe, coupler, etc., can hereby be used. Input and output signals are preprocessed in a suitable manner with regard to equalization, synchronization and the like. The subsequent perceptive analysis via the method cited above finally provides the effective amplification.

The effective amplification nearly completely describes the old hearing device from the point of view of the user (thus perceptively). This does not necessarily also correspond to a physically complete specification.

A target amplification is normally calculated in the first adjustment of a new device. This target amplification can now be approximated to the effective amplification, whereby the features of the new device (that, for example, the new device causes fewer distortions with long time constants) are additionally considered. Finally, the hearing device parameters of the new device are set such that the adjusted target amplification is achieved as precisely as possible. The (preferably dynamic) hearing device model cited above can be used for this.

Figure 2:
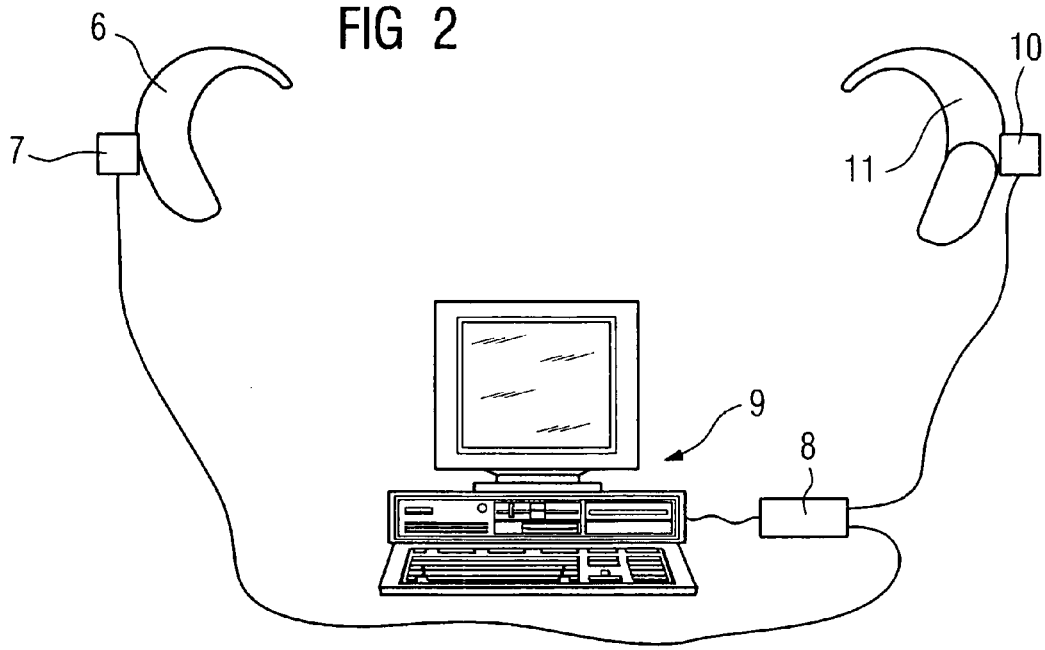
FIG. 2 is a pictorial drawing of a first embodiment of an inventive adjustment device.

FIG. 2 shows a concrete realization of a first embodiment. An old hearing device 6 has a programming jack into which a corresponding plug 7 is plugged. This plug 7 is connected with an auditory system programming interface 8 which, for its part, is controlled by a PC 9. The auditory system programmer interface 8 furthermore possesses a connection to a program plug 10 with which a new hearing device 11 can be programmed.

With this configuration, the frequency response and the other properties of the old auditory system 6 as well can be calculated over the auditory system programmer interface 8 via a modem. The data are stored in suitable form by way of adaptation software and made accessible for the adaptation of the new auditory system 11.

The computer-controlled readout of the setting parameters of the old hearing device 6 is a relatively quick and simple way to transfer the character of the old hearing device 6 to the new hearing device 11. For this, however, it is necessary that the old hearing device is compatible with the analysis device 7, 8, 9 with regard to software and hardware. Moreover, a corresponding translation software must be available with which the old parameters can be converted into corresponding new parameters for the new hearing device 11.

Figure 3:
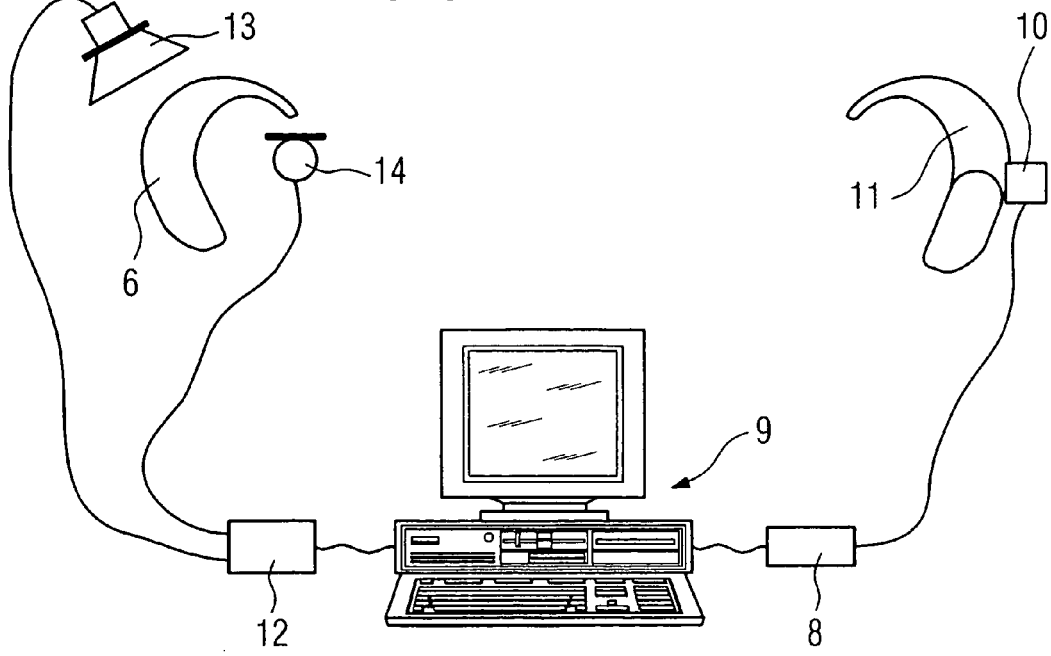
FIG. 3 is a pictorial drawing of a second embodiment of the inventive adjustment device.

When the determination of the properties of the old auditory system 6 is not possible or, respectively, the format of the properties is not compatible with that of the new auditory system 11, the frequency response as well as the other properties of the old auditory system 6 can be determined metrologically, as this is indicated in FIG. 3. For this, the PC 9 is connected with a computer-controlled measurement system 12 that possesses a loudspeaker 13 and a microphone 14. The measurement system is advantageously housed in a measurement box (not shown) and arranged such that a hearing device can be automatically measured in the measurement box.

The acoustic properties of the old auditory system are first measured in the measurement device or, respectively, measurement box under control of the measurement device 12. The acquired data are then accepted as target amplification curves in a suitable adaptation software for the new auditory system. The adaptation then ensues in that the corresponding setting parameters are imported into the new auditory system 11 via the auditory system programming interface 8.

Figure 4:
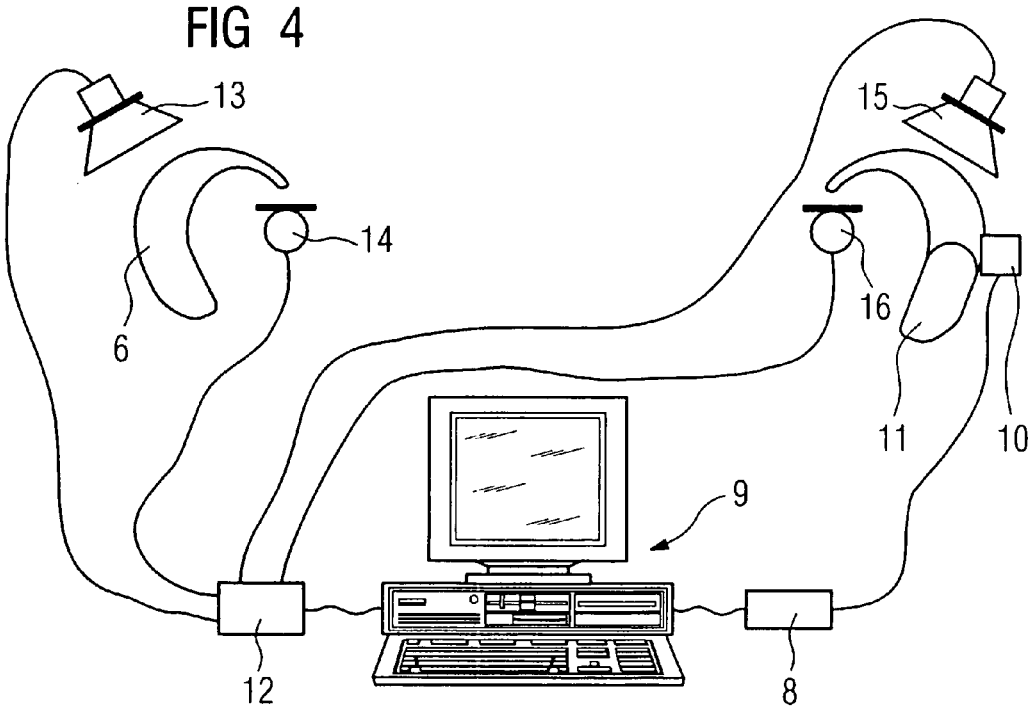
FIG. 4 is a pictorial drawing of a third embodiment of the inventive adjustment device.

FIG. 4 schematically shows a third embodiment of the inventive adjustment device. The design of this system corresponds in principle to that of FIG. 3. The measurement device is, however, additionally equipped with connections for a further loudspeaker 15 and a further microphone 16. This allows it to test the frequency response and other acoustic properties of the new auditory system 11 after the new programming. The adjustment of the new hearing device 11 can in this manner be implemented refined, since the adjustment system acquires feedback about the new programming via the loudspeaker 15 and the microphone 16.

Figure 5:
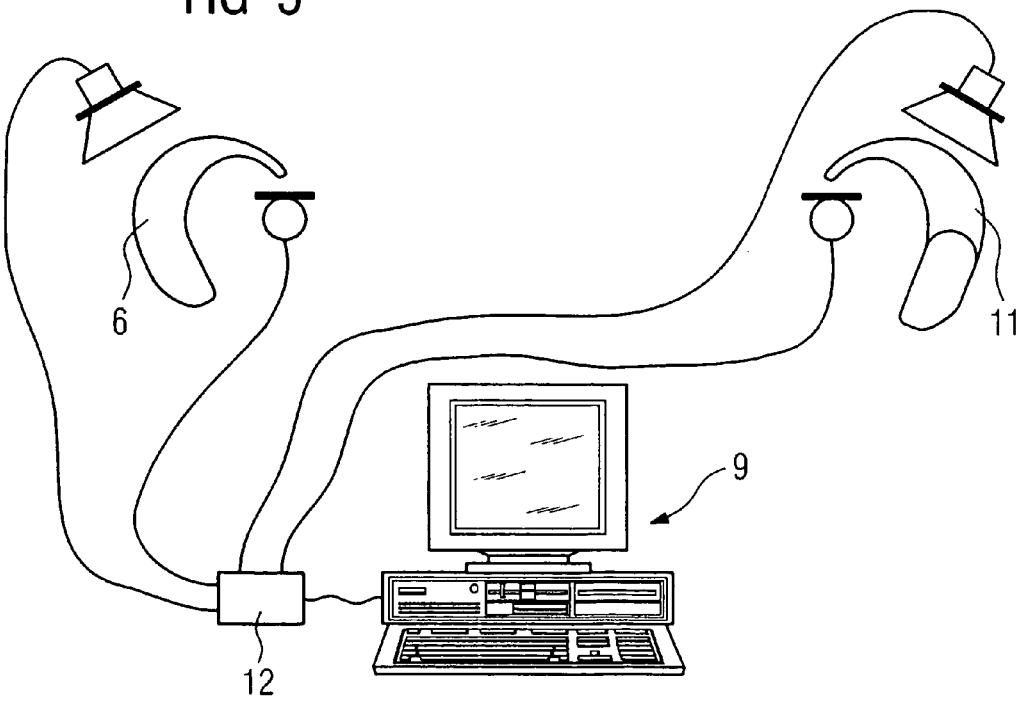
FIG. 5 is a pictorial drawing of a fourth embodiment of the inventive adjustment device.

A fourth embodiment of the present invention is sketched in FIG. 5. The assembly of the adjustment device corresponds substantially to that of FIG. 4. However, the new hearing device 11 here is not programmable via an auditory system programmer interface 8. Instead of this, the programming occurs by way of a controller on the auditory system, and the PC 9, with the adaptation software, shows the changes of the controller to be undertaken. These changes are derived from the metrological values that are acquired via the microphones 14 and 16, and if necessary iteratively (meaning, for example, controller change, measurement, controller change, measurement, etc.) optimized. In this manner, new systems can also be adapted to old systems even when both systems are incompatible with one another or with the adjustment device with regard to hardware or software.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The present invention may be described in terms of functional block components and various processing steps. Such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, where the elements of the present invention are implemented using software programming or software elements the invention may be implemented with any programming or scripting language such as C, C++, Java, assembler, or the like, with the various algorithms being implemented with any combination of data structures, objects, processes, routines or other programming elements. Furthermore, the present invention could employ any number of conventional techniques for electronics configuration, signal processing and/or control, data processing and the like.

The particular implementations shown and described herein are illustrative examples of the invention and are not intended to otherwise limit the scope of the invention in any way. For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

REFERENCE LIST

1 analysis
2 tone example
3 determination of the optimal setting
4 measurement data
5 dynamic model
6 old hearing device
7 plug
8 auditory system programmer interface
9 PC
10 programmer plug
11 new hearing device
12 measurement system
13, 15 loudspeaker
14, 16 microphone

What is claimed is:

1. A method to automatically adjust a new hearing aid, comprising the steps of:

temporarily bringing a first hearing aid, having an acoustic input and an acoustic output and that has been worn by a hearing-impaired person, into active communication with a measurement device that is a separate device from, and is external to, said first hearing aid;

from a processor, operating said measurement device to obtain, by said active communication with said first hearing aid, a detected operational characteristic of said first hearing aid that represents overall operation of said first hearing aid between said acoustic input and said acoustic output of said first hearing aid;

supplying said operational characteristic of said first hearing aid from said measurement device to said processor and, in said processor, automatically analyzing said operational characteristic of said first hearing aid to obtain an analysis result and automatically determining, fro said analysis result, setting parameters for electronic circuitry in a second hearing aid that is to replace said first hearing aid as a new hearing aid to be worn by said hearing-impaired person;

temporarily placing said second hearing aid in active communication with a setting device that is connected to said processor and that is a separate device from, and is external to, said second hearing aid; and from said processor, setting said electronic circuitry in said second hearing aid with said setting parameters via said active communication between said setting device and said second hearing aid.

2. A method as claimed in claim 1 wherein said first hearing aid has a memory in which setting parameters for electronic circuitry in said first hearing aid are stored, and wherein the step of obtaining said operational characteristic from said first hearing aid comprises reading out said setting parameters from said memory of said first hearing aid and supplying said setting parameters read from the memory of the first hearing aid to said processor, and wherein said second hearing aid has a memory connected to said electronic circuitry of said second hearing aid, and wherein the step of setting said electronic circuitry in said second hearing aid with said setting parameters determined from said operational characteristic of said first hearing aid comprises entering the setting parameters read from said memory of said first hearing aid into said memory of said second hearing aid.

3. A method as claimed in claim 1 wherein said measurement device comprises a speaker and a microphone, and wherein the step of obtaining said operational characteristic of said first hearing aid comprises emitting an acoustic signal from said speaker into said acoustic input of said first hearing aid and detecting an acoustic signal with said microphone from said acoustic output of said first hearing aid, and wherein the step of automatically analyzing said operational characteristic of said first hearing aid comprises automatically identifying, as said analysis result, a transfer function of said first hearing aid, between said acoustic input and said acoustic output, as a ratio of said signal supplied to said acoustic input of said first hearing aid and said signal emitted from said acoustic output of said first hearing aid.

4. A method as claimed in claim 1 wherein said measurement device is a first measurement device, and comprising placing said second hearing aid in active communication with a second measurement device, and operating said second measurement device from said processor to obtain an operational characteristic representing overall operation of said second hearing aid between an acoustic input thereof and an acoustic output thereof.

5. A method as claimed in claim 4 comprising, in said processor, automatically analyzing said operational characteristic of said second hearing aid and, from said operational characteristic of said second hearing aid, automatically determining modified setting parameters and, from said processor, re-adjusting said second hearing aid according to said modified setting parameters via said active communication between said second hearing aid and said setting device.

6. An adjustment device to automatically adjust a new hearing aid, comprising:

a measurement device that is separate from but configured to temporarily interact with a first hearing aid, having an acoustic input and an acoustic output and that has been worn by a hearing-impaired person, by active communication between the first hearing aid and the measurement device;

a processor connected to said measurement device that operates said measurement device to obtain, by said active communication with said first hearing aid, a detected operational characteristic of said first hearing aid that represents overall operation of said first hearing aid between said acoustic input and said acoustic output of said first hearing aid;

said processor being configured to automatically analyze said operational characteristic of said first hearing aid to obtain an analysis result and to determine, from said analysis result, setting parameters for electronic circuitry in a second hearing aid that is to replace said first hearing aid as a new hearing aid to be worn by said hearing-impaired person;

a setting device connected to said processor, that is separate from but configured to interact with said second hearing aid by temporary active communication between said setting device and said second hearing aid; and said processor operating said setting device to set said electronic circuitry in said second hearing aid with said setting parameters via said active communication between said setting device and said second hearing aid.

7. An adjustment device as claimed in claim 6 wherein said first hearing aid has a memory in which setting parameters for electronic circuitry in said first hearing aid are stored, and wherein said processor operates said measurement device to obtain said operational characteristic from said first hearing aid by reading out said setting parameters from said memory of said first hearing aid, and wherein said second hearing aid has a memory connected to said electronic circuitry of said second hearing aid, and wherein said processor operates said setting device to said electronic circuitry of said second hearing aid with said setting parameters determined from said operational characteristic of said first hearing aid by entering the setting parameters read from said memory of said first hearing aid into said memory of said second hearing aid.

8. An adjustment device as claimed in claim 6 wherein said measurement device comprises a speaker and a microphone, and wherein said processor operates said measurement device to obtain said operational characteristic of said first hearing aid by causing emission of an acoustic signal from said speaker into said acoustic input of said first hearing aid and by detecting an acoustic signal with said microphone from said acoustic output of said first hearing aid, and wherein said processor automatically analyzes said operational characteristic of said first hearing aid by automatically identifying, as said analysis result, a transfer function of said first hearing aid, between said acoustic input and said acoustic output, as a ratio of said signal supplied to said acoustic input of said first hearing aid and said signal emitted from said acoustic output of said first hearing aid.

9. An adjustment device as claimed in claim 6 wherein said measurement device is a first measurement device, and comprising a second measurement device that interacts with said second hearing aid by active communication between said second measurement device and said second measurement device, and operates said second measurement device to obtain an operational characteristic representing overall operation of said second hearing aid between an acoustic input and an acoustic output of said second hearing aid.

10. An adjustment device as claimed in claim 9 wherein said processor is configured to automatically analyze said operational characteristic of said second hearing aid and, from said operational characteristic of said second hearing aid, automatically determine modified setting parameters and to operate said setting device to re-adjusting said second hearing aid according to said modified setting parameters via said active communication between said second hearing aid and said setting device.

* * * * *